United States Patent [19]

Bert et al.

[11] Patent Number: 4,528,829

[45] Date of Patent: Jul. 16, 1985

[54] COMPOUND LOCK FOR BAGGAGE OR PARCEL LOCKERS AND THE LIKE

[75] Inventors: James D. Bert, Chester, Ill.; Nathan Cynamon, Miami, Fla.

[73] Assignee: American Device Manufacturing Company, Steeleville, Ill.

[21] Appl. No.: 72,087

[22] Filed: Sep. 4, 1979

[51] Int. Cl.[3] ..... E05B 11/00

[52] U.S. Cl. ..... 70/389; 70/139; 70/337

[58] Field of Search ..... 70/389, 337, 338, 339, 70/134, 139

[56] References Cited

U.S. PATENT DOCUMENTS

| | | | |
|---|---|---|---|
| 174,182 | 2/1876 | Bates . | |
| 1,432,720 | 10/1922 | Mosely . | |
| 1,439,042 | 12/1922 | Varnum et al. . | |
| 1,646,987 | 10/1927 | Benham . | |
| 2,163,121 | 6/1939 | Holtzman | 70/131 |
| 2,220,786 | 11/1940 | Grainger | 70/262 |
| 3,176,487 | 4/1965 | Davenbaugh | 70/139 |
| 3,813,905 | 6/1974 | Sauder | 70/339 |

*Primary Examiner*—Robert L. Wolfe

*Attorney, Agent, or Firm*—Rogers, Howell, Renner, Moore & Haferkamp

[57] ABSTRACT

A key retaining multiple lock mechanism, suitable for parcel lockers and other structures and capable of being mounted on doors for such structures, has a first lock with a first key trapping tumbler mechanism. The first lock has a strike-engaging tongue and a spring loaded bolt cooperating with a second lock dead bolt structure. The dead bolt is operated by a second key to extend and retract the dead bolt. When extended, the dead bolt compresses the spring-loaded bolt when the mechanism is in a locked condition and acts as a stop when the mechanism is in the unlocked condition, preventing relocking of the structure without first retracting the dead bolt with the second key.

9 Claims, 7 Drawing Figures

FIG. 4.
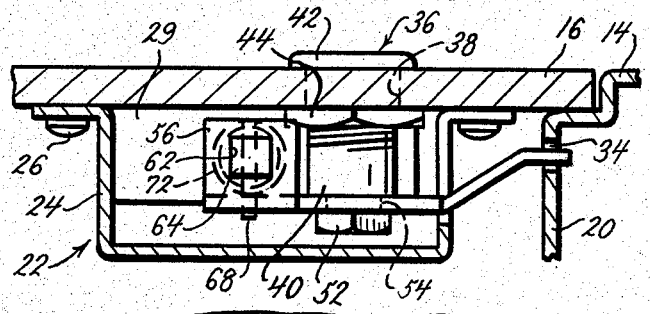
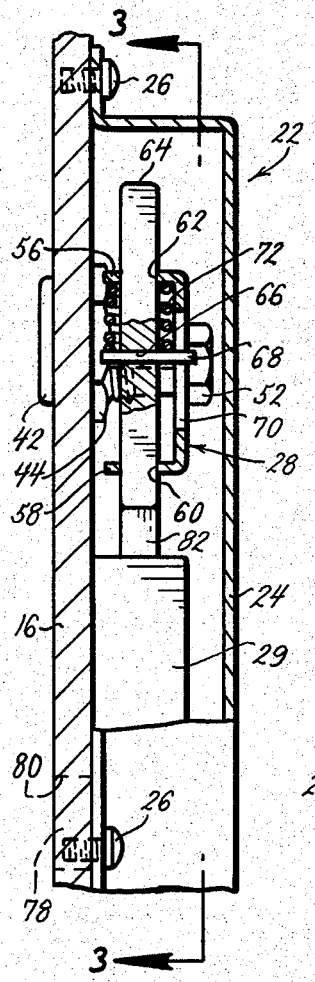
FIG. 2.
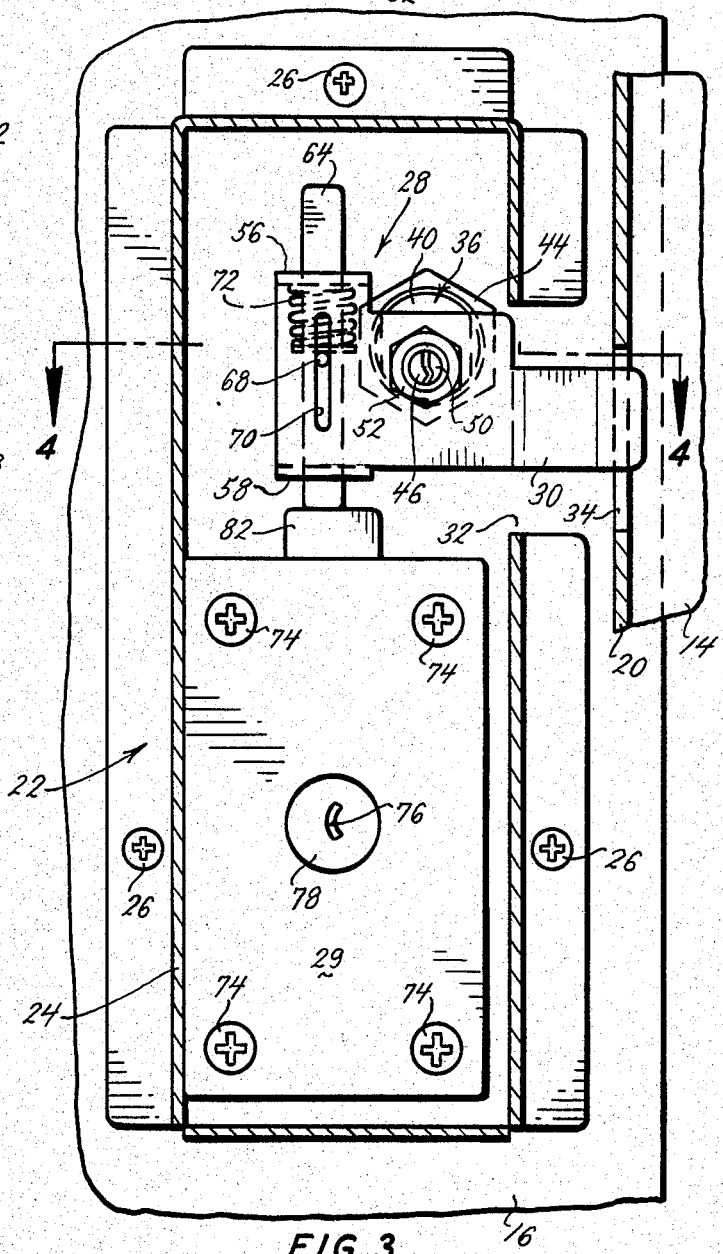
FIG. 3.

COMPOUND LOCK FOR BAGGAGE OR PARCEL LOCKERS AND THE LIKE

BACKGROUND AND SUMMARY OF THE INVENTION

In storage and parcel lockers, such as used in mail box systems in apartment houses and central offices, and in other parcel distributing facilities, frequently packages are encountered which are much larger than the box facilities which are available. This is particularly true, for example, in post offices and in apartment systems where the storage accessible to the postal customers is hardly larger than the normal letter. Frequently, large packages are left out, often unattended. For example, in a lobby or in the hall of an apartment house. These exposed packages are subject to pilferage, damage and theft.

To avoid loss, pilferage and damage, some facilities place large packages, in the care of an attendant, in a larger central storage room. The central storage room is not available to the postal customers or to the public, unless the attendant is present. This is an inconvenient system, since it depends on the presence of the attendant for distribution and normally requires the cost of hiring an attendant. Larger packages can be received by customers only during the portion of the day when the attendant is on duty.

Other systems may also be used, but each has its own undesirable features. Each expected customer or user may have an individual locker. However, this system is expensive and wastes space. Normally only a small percentage of customers, tenants in an apartment house for example, receive large parcels on any given day. A few lockers may be used and made accessible to all customers at all times. This system is inexpensive, but is not secure.

Applicants have devised a unique system for parcel lockers that is inexpensive, does not require an attendant, is accessible and secure. Applicants have devised a double lock mechanism for use in the system. The system may be used in a compound storage system where customers normally have access to a small box, for example, a mail box. In such systems there are a large number of small boxes, assigned one to each apartment or each postal customer. These boxes are normally of a letter size and the customer has access to the assigned box by key.

The following patents disclose two key locking mechanisms which are known to applicant.

174,182
1,154,271
1,432,720
1,439,042
1,646,987
2,163,121
2,220,786
3,813,905

The disclosures of the above patents are incorporated by reference herein.

DESCRIPTION OF THE DRAWINGS

FIG. 2 is a partial sectional view taken along the plane of line 2—2 in FIG. 1.

FIG. 3 is a cross-sectional view of the lock mechanism taken along the plane of line 3—3 in FIG. 2.

FIG. 4 is a cross-sectional view of the lock assembly taken along the plane of line 4—4 in FIG. 3.

DESCRIPTION OF THE PREFERRED EMBODIMENTS

Figure 1:
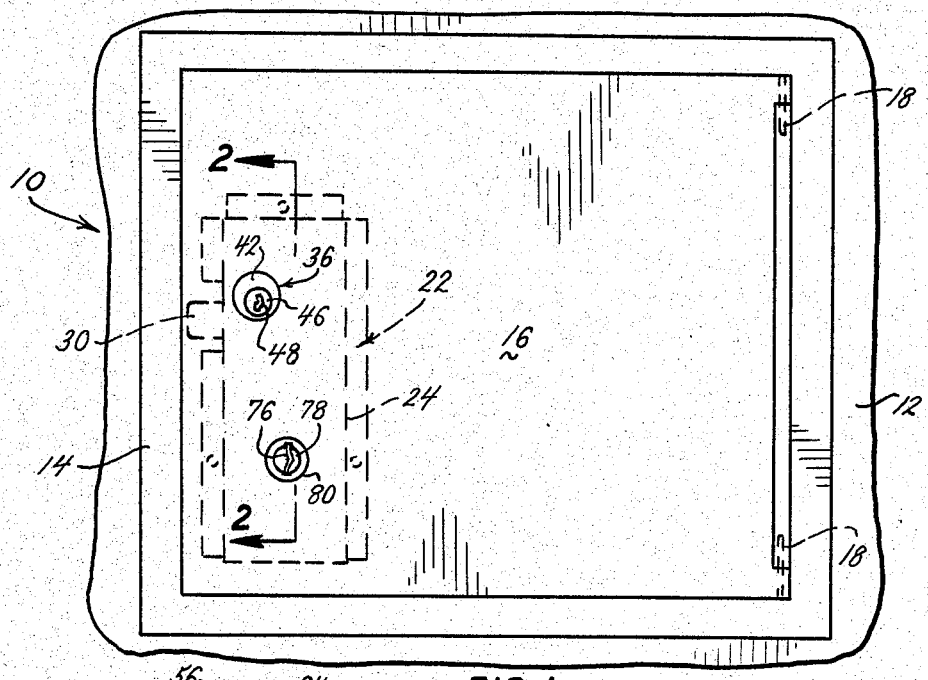
FIG. 1 is a front view of a parcel locker having the mechanism of the invention.

Referring in more detail to the drawings, a parcel locker 10 is mounted in a wall 12, for example, in the lobby of an apartment house. Parcel locker 10 can be part of a bank of parcel lockers and mail boxes or can be placed in a separate location apart from mail boxes. Parcel locker 10 has a frame 14 in which a door 16 is mounted by hinges 18. Frame 14 has a strike portion 20, as shown in FIG. 4.

Mounted on the inside of door 16 is a lock mechanism 22, which is concealed when the door 16 is closed. Lock mechanism 22 is mounted adjacent to the strike portion 20 on frame 14 and in a cooperating relationship thereto, as shown. Lock mechanism 22 has a cover plate 24 secured to door 16 by screws 26, as shown in FIGS. 2 and 3. Screws 26 may be ordinary screws or may be of the tamper resistent type. Lock mechanism 22, which is placed within cover plate 24 to prevent tampering when the locker is open, has two parts, a spring bolt and tongue lock structure 28 operated by a key, as shown in FIG. 3, and a dead bolt lock structure 29 operated by a separate key.

The tongue lock 28 has an outwardly extending tongue 30 which extends through a slot 32 in cover 24 and cooperates with slot 34 in strike 20 when operated to hold the locker door 16 in the closed and locked condition. Tongue 30 of tongue lock mechanism 28 may be pivoted into and out of cooperating engagement with slot 34 in strike 20 by use of a key which activates a tumbler lock cylinder 36. Lock cylinder 36 extends through a bore 38 in door 16, as shown in FIG. 4. Lock cylinder 36 has a threaded external portion 40 and a bezel 42 of larger diameter than the cylindrical surface 40. A jam nut 44 is threadingly received over cylindrical surface 40 and abuts against door 16 so that the door 16 is tightly held by jam nut 44 and bezel 42, thereby mounting the entire lock structure 28 to door 16.

Lock cylinder 36 also has internal portion 46, which is rotatable relative to the external surface 40, by means of a key operating in key way 48. Rotatable portion 46 terminates in a threaded bolt 50 which projects into the interior of the locker 10. A jam nut 52 is threadingly received on the bolt 50. Tongue 30 has a bore 54 which is received over bolt 50 and held tightly thereto, and to rotating portion 46, by jam nut 52. Tongue 30 may be pivoted by rotation of rotating portion 46 when operated by a key acting through keyway 48.

Rotatable portion 46 contains tumblers, not shown, which are of the key trapping type, known to the art. A key cannot be removed from key way 48, except when the entire lock assembly is in the locked position, as shown in FIG. 3. When the key, lock tumblers and rotating portion 46 are displaced angularly from the position shown in FIGS. 3, 6 and 7, the key is retained in the key way 48. The tumblers prevent withdrawal of a key when the lock mechanism 28 is in the position shown in FIG. 5.

Figure 7:
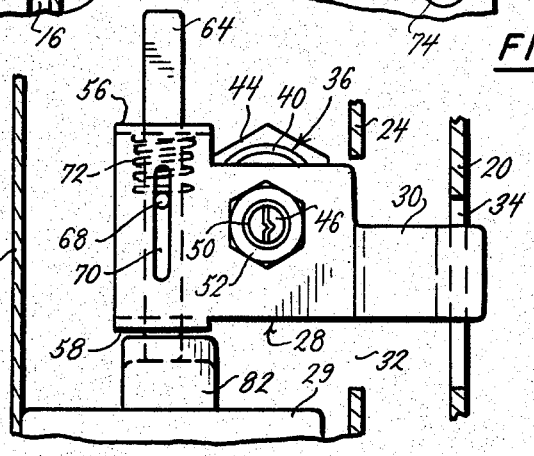
FIG. 7 is a view, similar to FIGS. 5 and 6, showing the completely relocked mechanism.

Tongue 30 has integral parallel flanges 56 and 58 on the portion of the tongue 30 which is remote from the strike 20, as shown in FIG. 3. Flanges 56 and 58 have holes 60 and 62 through which a bolt 64 is mounted, which may be square as shown. Bolt 64 has a transverse bore 66 through which a pin 68 passes. Tongue 30 has a slot 70 extending generally parallel to the major axis of bolt 64. Pin 68 also passes through slot 70, as shown in FIGS. 2 and 3. A spring 72 is confined between flange 56 of tongue 30 and pin 68. Spring 72 is compressed by upward displacement of bolt 64 and applies downward force to bolt 64 through pin 68, as shown in FIGS. 3 and 7.

Dead bolt lock 29, which may be of conventional design, is positioned in a cooperating relationship with tongue lock 28, for example as shown in FIG. 3. Dead bolt lock 29 is mounted by screws 74 to door 16. Dead bolt lock 29 is activated by a key in cooperation with key way 76 in lock cylinder 78, which passes through bore 80 in door 16. Operation of dead bolt lock 29 reciprocates dead bolt 82, as shown in FIG. 3. When the locker is locked by tongue lock 30, dead bolt 82 is extended beneath bolt 64 of tongue lock 28 and forces bolt 64 upwardly, compressing spring 72.

OPERATION AND USE OF THE DEVICE

The operation and use of the device will be described with respect to a mail locker, for example as part of a bank of ordinary mail boxes in a large apartment building. It will be appreciated that the device can also be used in a central postal station or other facility.

In use, oversize parcels, for example parcel post, would be placed in the locker 10 by the postal delivery employee who would have a master key to dead bolt lock 29. The key to tongue lock 28 is trapped in the tumblers of lock cylinder 36, except when the locker 10 is locked. When the postal delivery employee delivers parcels the locker is unlocked. The parcel is placed in the locker 10 and the locker 10 is locked by the procedure described more fully herein. The key to the dead bolt lock 29 is removed and is retained by the postal delivery employee. The key to the tongue lock 28 is removed and placed in the mail box of the addressee for the package placed in the locker 10. The handle or flag for the key to tongue lock 28 is provided with sufficient indicia to indicate to the addressee which locker contains the delivered package. When the addressee goes to the mail box, the key to the parcel locker is found. The addressee then takes it to the parcel locker to unlock it and retrieve the package. When the addressee reaches the locker, the lock is in the locked condition, as shown in FIG. 3. The addressee inserts the key to the tongue lock 28 and rotates the mechanism by use of the key to the position shown in FIG. 5, the tongue 30 clears strike 20 and the door 16 to the locker 10 can be opened.

Figure 5:
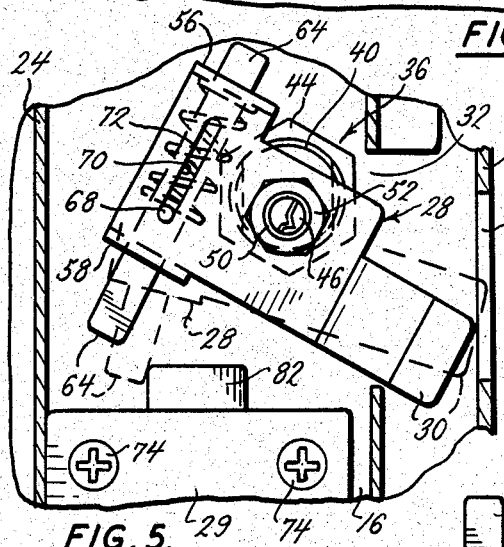
FIG. 5 is a partial cross-sectional view, similar to FIG. 3, showing the mechanism in the unlocked condition.

In reaching the position shown in FIG. 5, spring bolt 64 moves, by pivoting, so that it is no longer supported on dead bolt 82. Spring 72, acting through pin 68, forces spring bolt 64 downwardly to the position shown in FIG. 5. In this position it is not possible to repivot tongue lock 28 into the locking position using the tongue lock key alone, since spring bolt 64 will not clear dead bolt 82. See the illustration shown in phantom in FIG. 5. In this unlocked condition the key to tongue lock 28 remains trapped in tumbler cylinder 36. The addressee retrieves the package and leaves the locker in the unlocked condition.

Figure 6:
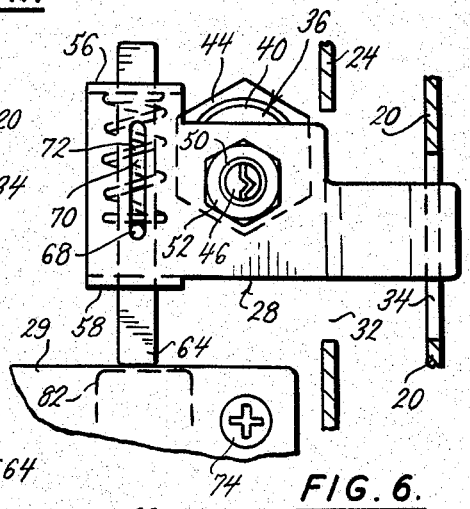
FIG. 6 is a view, similar to FIG. 5, showing the mechanism being repositioned to the locked condition.

When the locker is to be used again, the postal delivery employee may place a second package to a different addressee in the same locker 10. The locker 10 is then relocked using the master key to dead bolt lock 29. First dead bolt 82 is retracted to the position shown in FIG. 6. In this position tongue lock 28 can be repivoted, by use of its key, to the locked position, as shown in FIG. 6, and the key to tongue lock 28 can be withdrawn. Spring bolt 64 remains in an extended position. To reset the anti-lock feature, the postal delivery employee then uses the master key to dead bolt lock 29 to extend dead bolt 82, thus moving spring bolt 64 and compressing spring 72. See FIG. 7.

The above described system provides security against damage and loss, does not require the presence of an attendant to distribute packages and does not require an inordinate number of oversize lockers or the space occupied by oversize lockers. It will be understood that the above description may be modified as will be apparent to those skilled in the art. The invention is not to be limited to the precise mechanism illustrated and described, but only by the scope of the claims attached hereto.

I claim:

1. A lock mechanism having means to engage a strike including a tongue latch means, means operable to pivot the strike engaging means out of engagement with the strike, and means to fix the strike engaging means in an unlocked, disengaged position, the disengagement fixing means including an anti-reset bolt on the tongue latch means, the anti-reset bolt having spring means to drive the bolt to a disengagement locking position when the tongue latch means is pivoted out of engagement with a strike.

2. The lock mechanism of claim 1 wherein the lock mechanism has means to move the anti-reset bolt and compress the spring means to reposition the anti-reset bolt when the lock mechanism is reset to a locking position.

3. The lock mechanism of claim 2 wherein the means to reposition the anti-reset bolt includes a deadbolt and means to extend the deadbolt to move the anti-reset bolt and compress the spring of the anti-reset bolt and retain the anti-reset bolt in an unlocked position.

4. A lock mechanism having means to engage a strike, means operable to move the strike engaging means out of engagement with a strike and means to fix the strike engaging means in an unlocked disengaged position including an anti-reset bolt on the strike engaging means, the anti-reset bolt having spring means to drive the bolt to a disengagement locking position when the strike engaging means is pivoted out of engagement with a strike, the lock mechanism having a deadbolt means retaining the anti-reset bolt in a disengagement locking position, the lock mechanism having means to retract the deadbolt to allow the strike engaging means to be reset into a strike engaging position and having means to extend the deadbolt to compress the spring means and reposition the anti-reset bolt when the lock mechanism is reset to a locking position.

5. The lock mechanism of claim 4 wherein the strike engaging means includes a tongue latch means.

6. The lock mechanism of claim 5 wherein the device has key responsive means to pivot the tongue latch into and out of engagement with a strike.

7. The lock mechanism of claim 6 wherein the lock mechanism has means to retain a key when the mechanism is in the unlocked position.

8. The lock mechanism of claim 4 wherein the deadbolt means has a key operating means.

9. A lock mechanism having means to engage a strike, means operable to move the strike engaging means out of engagement with a strike and means to fix the strike engaging means in an unlocked disengaged position, the strike engaging means including a first lock having a first key operated tumbler to operate the lock, and wherein the lock mechanism has a second lock cooperating with the first lock, the second lock having a second key operated dead bolt, the first lock having means to mount the first lock on the door of a locker including a lock cylinder containing the tumbler, a flange of increased diameter at one end of the lock cylinder, the lock cylinder having a threaded exterior surface and having a jam nut threadingly received thereon, the lock cylinder being adapted to pass through a bore in the cover or door of a storage locker and be retained thereon by threading the jam nut along the threaded surface of the tumbler cylinder to engage the opposite side of the door from the flange, the tumbler being rotatable relative to the outer surface of the lock cylinder and having a key way extending longitudinally of the lock cylinder and accessible by a key, the tumbler extending beyond the threaded surface of the lock cylinder and terminating in a threaded member having a diameter less than the diameter of the threaded surface of the lock cylinder, the threaded member having a jam nut threadingly received thereon and having a transversely extending tongue mounted on the threaded portion and retained thereon by the jam nut, the tongue having a first end adapted to engage a strike on the frame of a locker and having a second end remote from the first end, the second end having two parallel flanges extending perpendicular to the tongue body and spaced apart defining a space therebetween, each flange having a perforation extending therethrough, the perforations on the flanges being concentric, the tongue having a bolt extending through each of the concentric perforations, the second end of the tongue having a slot therein extending substantially axially of the bolt, the bolt being retained in the flanges by a pin passing transversely through the bolt, the pin being received in the slot, the bolt and tongue having a spring captured between the pin and a flange, the spring, when compressed, exerting a force on the bolt through the pin; the second lock being positioned to cooperate with the first lock and having a dead bolt, so that when the first lock is in the locked position, the spring bolt is retained by the dead bolt with the spring compressed and when the tongue lock is in the unlocked position, the spring bolt is extended by the spring, the first lock being retained in the unlocked position by the dead bolt until the dead bolt is retracted.

* * * * *